United States Patent [19]

Anderson

[11] 4,120,062

[45] Oct. 17, 1978

[54] WATERBED ENVIRONMENTS

[76] Inventor: Richard P. Anderson, Albert Meadow, Bar Harbor, Me. 04689

[21] Appl. No.: 670,438

[22] Filed: Mar. 25, 1976

[51] Int. Cl.[2] ..... A47C 27/08

[52] U.S. Cl. ..... 5/370; 5/108; 128/33; 5/60

[58] Field of Search ..... 5/365, 367, 370, 371, 5/349, 350, 366, 60, 108; 128/1 R, 33

[56] References Cited

U.S. PATENT DOCUMENTS

| | | | |
|---|---|---|---|
| 504,443 | 9/1893 | Staab | 5/366 X |
| 2,250,325 | 7/1941 | Barnes | 5/366 X |
| 2,686,006 | 8/1954 | Hasselquist | 5/349 X |
| 3,108,293 | 10/1963 | King | 5/370 |
| 3,419,923 | 1/1969 | Cowan | 128/330 UX |
| 3,585,356 | 6/1971 | Hall | 5/370 |
| 3,670,347 | 6/1972 | Weinstein | 5/370 |
| 3,672,354 | 6/1972 | Weber | 128/33 |
| 3,742,531 | 7/1973 | Alsbury et al. | 5/370 |
| 3,809,065 | 5/1974 | Gatts | 128/1 R |

*Primary Examiner*—Casmir A. Nunberg

[57] ABSTRACT

This invention relates to a new and improved infant WATERBEDS ENVIRONMENTS designed to simulate the intrauterine environment. This is achieved by the use of a specially designed water filled bladder pulsated by means of a pump which generates rushing water, or by a mechanical device which imparts impulses to said bladder. Audible and tactile sensations created by the pulsating devices and the rushing movement of water coact to recreate aspects of the prenatal infant environment. Novel safety features incorporated into the waterbed include a bladder designed to drain from the top, a permeable supporting structure, and a curved base to allow immediate dissipation of water in the event of a leak.

3 Claims, 13 Drawing Figures

WATERBED ENVIRONMENTS

BACKGROUND OF THE INVENTION:

This invention relates to a new and improved waterbed environments particularly for infant use and for hospital and bedridden patients.

Warmth, motion, tactile sensation, and sound are important sensations imparted by the mother to an infant. Not only important to its psychological well being, these senses have direct bearing to the physical health of an infant.

Exact reasons are not known, but crib deaths are statistically higher in colder winter months indicating temperature has a cause and effect upon the disease. It is also known that respiratory and other ailments are more prevalent among infants subjected to colder environments. Heating elements warming the bladder would help the infant to be kept at a controlled temperature.

Oscillating, rocking, or vibrating beds and cradles have, in the past, been designed to provide a number of compound motions, for example: motion in the vertical and horizontal plane (U.S. Pat. No. 3,453,999 to Neal), oscillating motion (U.S. Pat. No. 3,809,065 to Gatts), and vibrating (U.S. Pat. No. 3,878,570 to Donnelly).

In a preferred process embodiment, the present invention achieves motion and tactile sensation more natural to the infant due to its pulsating, fluid characteristics and ability to be synchronous to sound. The elasticity of the bladder allows this motion and tactile sensation to effect a larger portion of the body surface area than a conventional mattress. In addition to motion and certain tactile sensations having beneficial psychological effects on an infant, it must also be noted that pulsation causes an alternate compression and distension of the lungs thereby assisting respiration.

Alternative mechanical methods of pulsation could be used, however, the preferred embodiment of this invention includes a pump which pulsates the bladder by intaking and displacing water inside the bladder producing periodic rushing or streaming of water. This means most nearly duplicates the heart function, the difference being the heart pumping blood rather than water. The sound of water rushing and gurgling through a valve at rythmic intervals timed to coincide with the rate of heartbeat would simulate the body sounds of the mother as fluid sound transmission is approximately five times as efficient as air sound transmission. It must be noted that previously disclosed methods of simulating heartbeat or interuterin din electronically (U.S. Pat. No. 3,809,065 to Gatts) is, for one, second generation sound and therefore not natural, and secondly, it is not synchronous with the movement.

Waterfilled mattresses, or so called waterbeds, have been in use for some time, and diminutive manifestations of adult waterbeds designed for infants have been previously disclosed or used. However, the basic problem inherent to a waterfilled mattress for infant use is the fact that an unattended infant could not get up by itself in the event of a leak or burst to save itself from drowning. The preferred embodiment of this invention protects the infant from accidental drowning by utilizing novel protective safeguards in its design.

A leak eminating from the top of the bladder, for example, a puncture caused by a diaper pin, could cause water to flow to the impression made by the weight of the infant upon the bladder. By creating a bladder that would drain from the top, protection would be afforded to the infant from drowning in a pool of water made by a slow leak flowing to the impression caused by the infant's weight.

An additional safety feature incorporated in the design acts as a fast drain means in the event that the leak was too fast to be drained from the top, as in the case of a seam rupture. A curved base with a slight tolerance between the infant and the apex of the curve would allow the infant to come to rest on the base as soon as water was displaced from the bladder. The design would permit the infant to rest high and dry with the displaced water flowing to the sides. A permeable structure surrounding the bladder permits immediate dissipation of water.

An alternate method of protecting the waterbed occupant from drowning is provided by covering the top portion of the bladder with a second, non-permeable membrane. This second layer would act as a barrier to water leaking from the bladder.

Waterbeds have particular benefits for use by bedridden patients prone to develop bedsores. Certain features of the infant waterbed environment would have beneficial applications for use by adults. The waterbeds currently used by hospital patients must necessarily use a thick membrane to avoid possible leaking and thereby reducing the elasticity of the surface. The second membrane means of leak protection permits a thinner, more elastic surface thereby allowing the bladder to affect more body surface area while being safer.

A novel feature of the second membrane in its application for adult use is its ability to be raised or lowered in the manner of a conventional hospital bed allowing portions of the occupant's body to be moved.

Means for raising or lowering body temperatures are effected by heating or refrigerating elements incorporated in the waterbed environment.

DETAILED DESCRIPTION OF THE DRAWINGS

Figure 1:
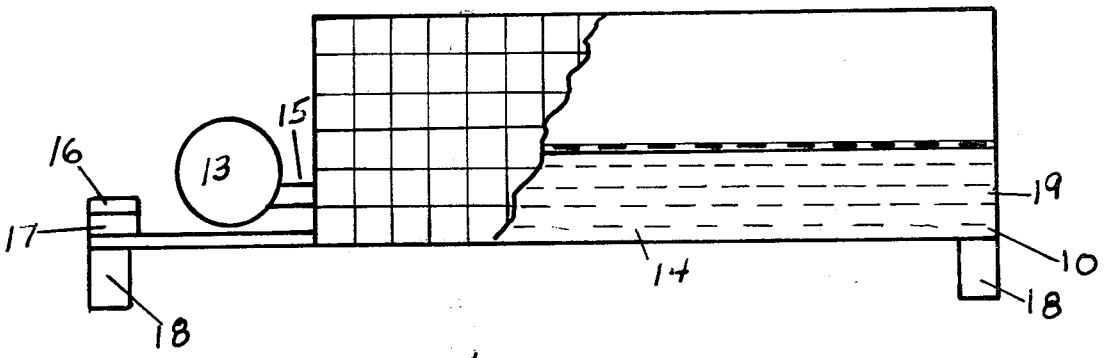
FIG. 1 is a side view of the infant waterbed environment.

In FIG. 1 the component that houses and supports the apparatus of the infant waterbed environment is designated by the numeral 10. The preferred embodiment of said component 10, is a molded plastic structure designed to house a pulsating device 13, a thermostat control 17, heating elements 14 embedded in the plastic, a ground fault interrupter 16, and a water filled bladder 19.

The construction of the base and sidewalls are of screened or grilled material making it permeable to water thus allowing immediate dissipation in the event of a leak from the bladder. Legs of indeterminate length 18, would keep the base structure 10 from coming in contact with anything that would reduce its permeability and slow dissipation of water.

Figure 2:
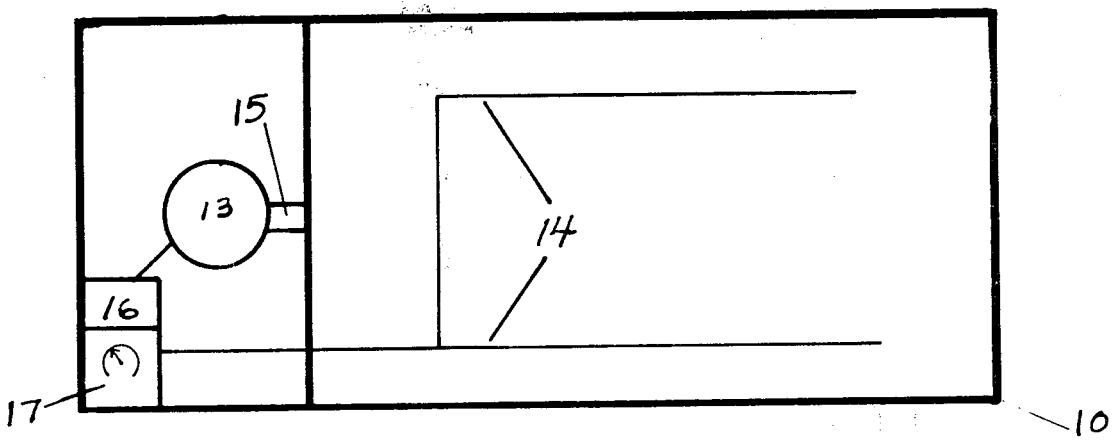
FIG. 2 is a plan view of the infant waterbed environment without the water filled bladder.

Heating elements FIG. 2 14 are embedded in the molded plastic base 10 below the bladder 19, thus affording electrical insulation between the bladder 19 and said elements 14. The elements 14 are wired to a thermostat device 17 permitting incremental temperature control of the bladder 19.

Figure 8A:
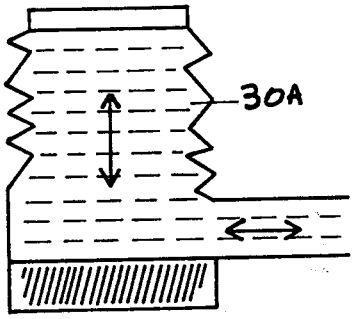
FIG. 8A is a diagram of an alternate, flexible reservoir, pump means of pulsation.
Figure 8:
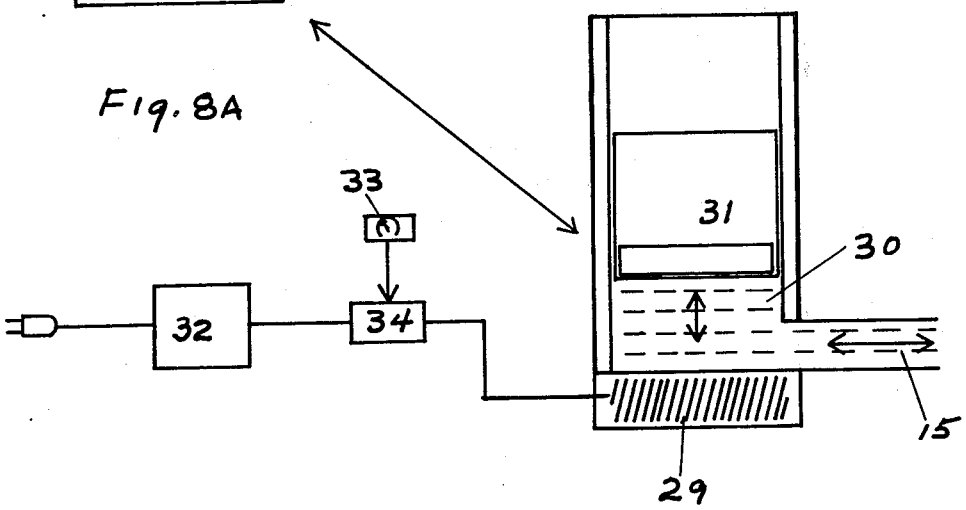
FIG. 8 is a diagram of a fixed reservoir pump means of pulsation.

The preferred embodiment of the pulsating device 13 is illustrated in FIGS. 8 and 8A. Said pulsating device 13 generates movement of water inside of the bladder 19 by means of an electromagnetic pump. Water inside a fixed reservoir FIG. 8, 30 is forced through a valve 15 when an electromagnetic signal from the coil 29 draws the electromagnetic piston 31 downward. Signal from a transformer rectifier 32 is fed to a polarity switch 34 which reverses the downward movement of the piston and allows the reservoir to be refilled. Frequency is controlled by a timer 33 acting upon said polarity switch 34 and is adjustable.

The aformentioned electromagnetic pump can use, as an alternative, a flexible diaphram reservoir 30A as shown in FIG. 8A.

Figure 7:
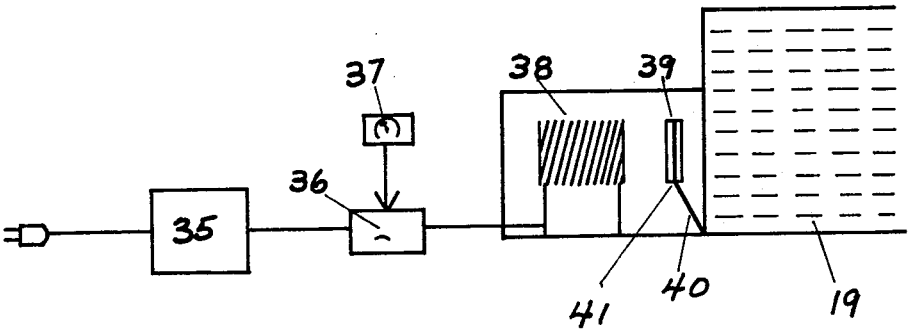
FIG. 7 is a diagram of the mechanical means of pulsation.

An alternate, mechanical pulsating device is shown in FIG. 7. Motion and sound are created inside the bladder when a beating device strikes the bladder causing local deformation. A beating device 40 is caused to move to and fro when an electromagnetic impulse is sent from the coil 38 to an electro magnet attached to a flexible beating rod 40. Signal from a transformer rectifier 35 is fed to a polarity switch 36 which alternately reverses signal from the electromagnetic coil 38 to the electromagnetic beater 41 thus causing the beater to strike the bladder and then recoil. Frequency of beating is achieved by a timer 37 acting upon the polarity switch 36 and is adjustable.

All electrical wiring is connected to a ground fault interrupter, FIG. 1, 16, to prevent grounding and possible electrocution.

Figure 3:
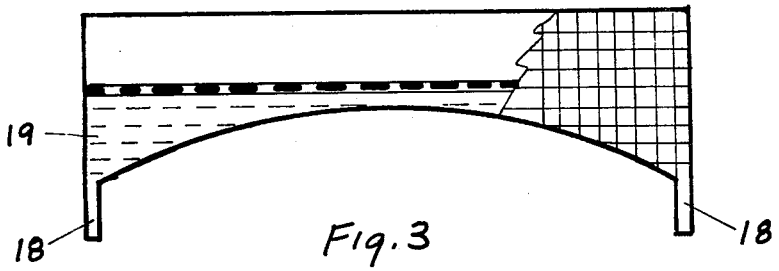
FIG. 3 is an end view of the infant waterbed environment.
Figure 4:
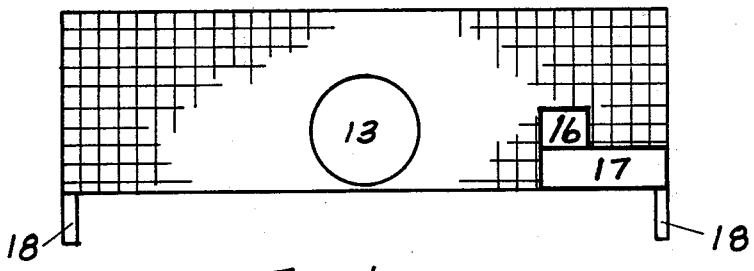
FIG. 4 is an end view of the infant waterbed environment showing pulsating device, temperature control, and ground fault interrupter.
Figure 5:
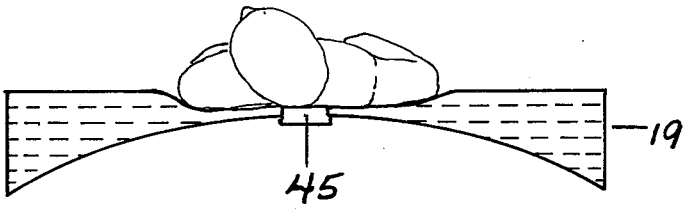
FIG. 5 is an end view of the bladder.
Figure 6:
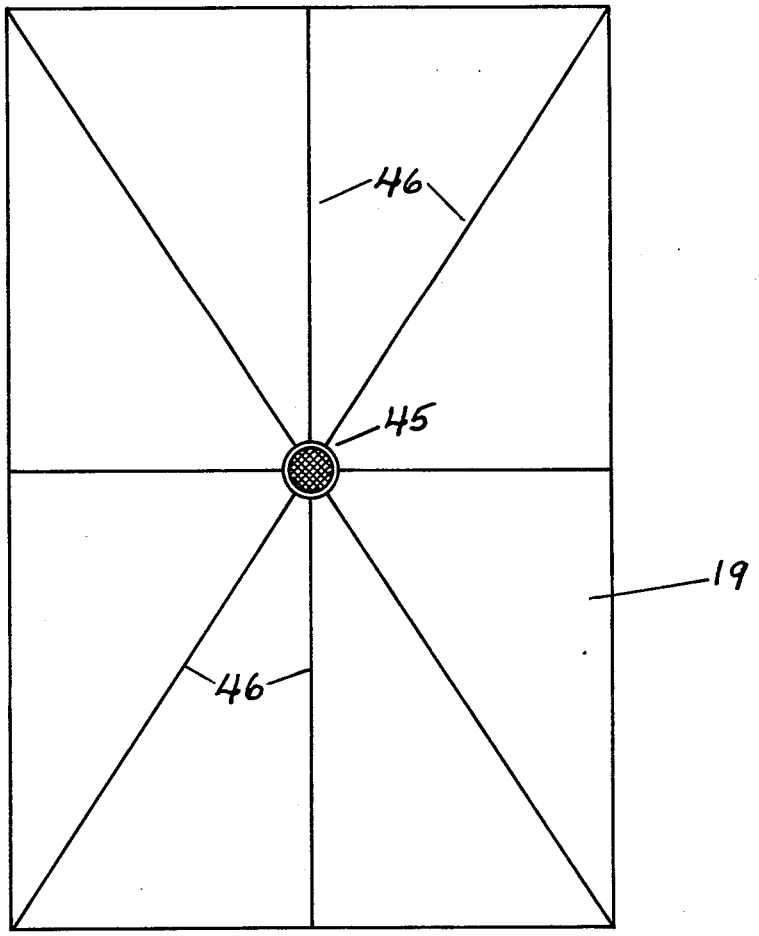
FIG. 6 is a plan view of the bladder.

Safety features are incorporated in the base, FIG. 3 & 4, 10, and bladder FIG. 5 & 6, 19, to prevent possible drowning. Creases FIG. 6, 46, imbedded on the top portion of the bladder lead to a center drain, FIG. 5 and 6, 45, that extends through the bladder 19 and base 10. Said feature prevents fluids from standing in the impression caused by the weight of the occupant upon the bladder.

Figure 9:
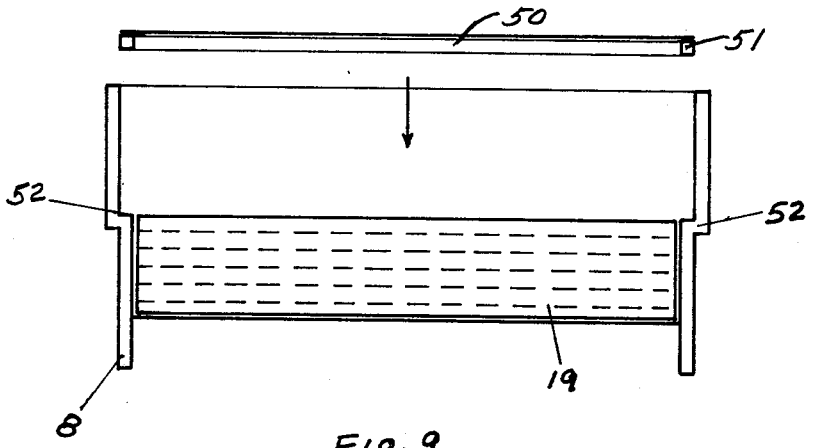
FIG. 9 is an end view of a second membrane means of preventing leakage water from reaching the occupant.
Figure 10:
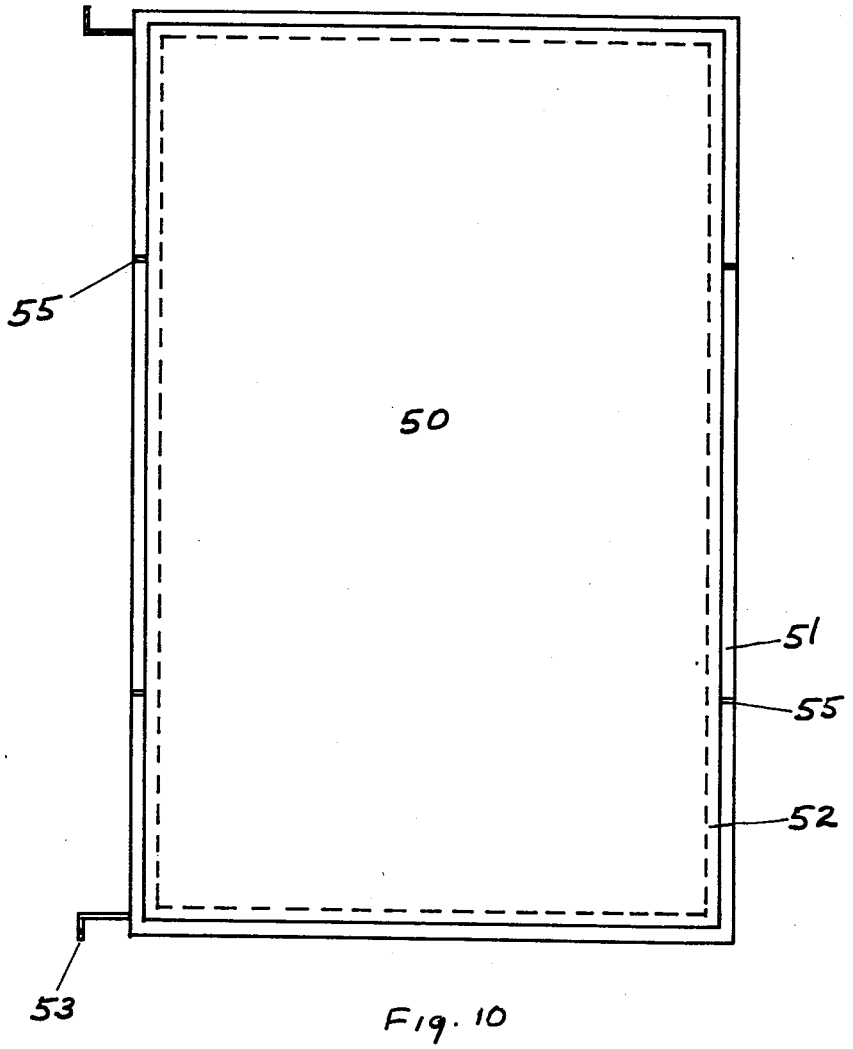
FIG. 10 is a plan view of the second membrane means.

An alternate means of protection from drowning in the event of a leak is a second membrane, FIG. 10, 50 covering the top portion of the bladder 19. Said second membrane 50 is attached to a frame 55 and rests on a lip, FIG. 9, 52, formed in the base structure.

Figure 11:
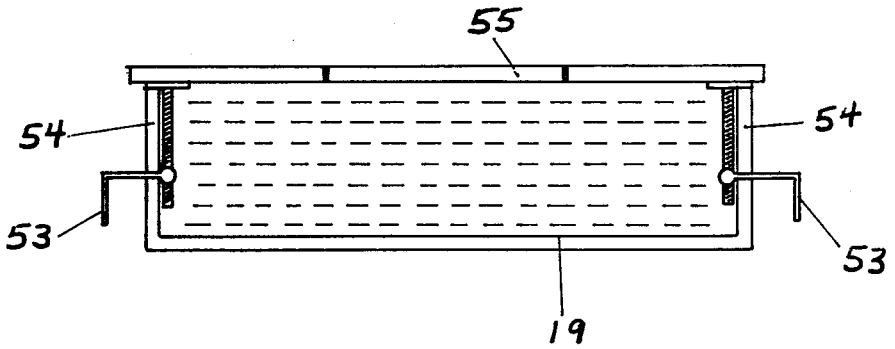
FIG. 11 is a side view of the second membrane means of elevation.
Figure 12:
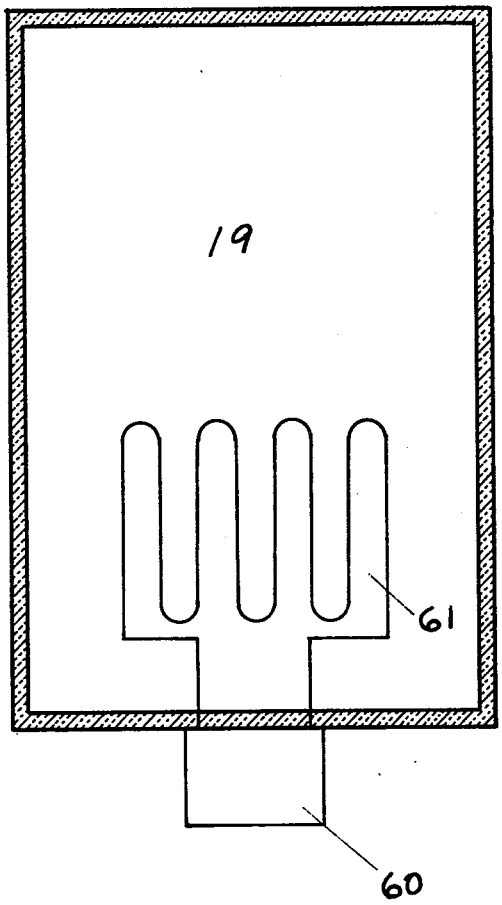
FIG. 12 is a plan view of means for refrigerating waterbed environment.

Means for raising or lowering sections of the second membrane 50 are achieved by a worm gear hand crank, FIG. 11, 53, 54. The frame of the second membrane 51 is hinged 55 so as to allow the end sections to be raised or lowered independently. In FIG. 12, the bladder is combined with a conventional refrigerating system in which refrigerating fluid circulates between compressor 60 and condensor coils 61 which are located beneath the bladder 19.

What is claimed is:

1. An infant waterbed environment comprising:

water bladder means;

means for supporting said bladder means comprising a porous sidewall pervious to the passage of water and a base of convex curvature upwards adapted to shed water away from said base in the event of a leak in the bladder;

means for displacing water contained in the bladder means at selected frequencies to provide pulsations sensible to an infant on the water bladder comprising displacement pump means and reservoir means communicating with the bladder means, said pump coupled with said reservoir for displacing water into the bladder from the reservoir and withdrawing water from the bladder into the reservoir at selected frequencies thereby providing pulsations of rushing water in the bladder means and consequently a sensible and audible environment which recreates aspects of the intrauterine environment;

and means for adjusting the frequency of the pulsations produced by said displacement pump.

2. An infant water environment comprising:

waterbed bladder means, said bladder means formed with central drainage means extending from the upper surface of said bladder through said bladder for draining water away from the upper surface of the bladder and away from the impression created by the weight of the infant in the event of a leak in the upper surface of the bladder means;

means for supporting said bladder means comprising a base and porous sidewalls pervious to the passage of water;

and means for displacing water contained in the bladder at predetermined frequencies to provide pulsations sensible to an infant of the waterbed bladder means reminiscent of the intrauterine din, said means for displacing water comprising means for generating rushing water within the bladder at said preselected frequencies thereby recreating audible and sensible aspects of the prenatal infant environment.

3. An infant waterbed environment comprising:

waterbed bladder means suitable for containing water;

means for supporting said bladder means comprising a base and sidewalls;

means for displacing water contained in the bladder at pre-determined frequencies to provide pulsations sensible to an infant on the waterbed bladder means, said means for displacing water comprising means for periodically externally and locally deforming the bladder means when filled with water comprising striker means for depressing a surface of the bladder;

and means for actuating the striker at pre-selected frequencies thereby generating pulsations both felt and heard by the infant that propagate across the waterbed affording sensations reminiscent of the pre-natal infant environment.

* * * * *